United States Patent [19]

Sasaki

[11] Patent Number: 4,757,798

[45] Date of Patent: Jul. 19, 1988

[54] ELECTRONIC DISTRIBUTION BACKUP APPARATUS

[75] Inventor: Shoji Sasaki, Katsuta, Japan

[73] Assignee: Hitachi, Ltd., Tokyo, Japan

[21] Appl. No.: 30,590

[22] Filed: Mar. 27, 1987

[30] Foreign Application Priority Data

Mar. 28, 1986 [JP] Japan ..... 61-68466

[51] Int. Cl.[4] ..... F02P 5/15

[52] U.S. Cl. ..... 123/643; 123/630

[58] Field of Search ..... 123/414, 479, 609, 630, 123/643, 416, 417

[56] References Cited

U.S. PATENT DOCUMENTS 4,457,286 7/1984 Katayama et al. ..... 123/643 X
4,485,784 12/1984 Fujii et al. ..... 123/643 X
4,531,190 7/1985 Drews et al. ..... 123/479 X
4,611,565 9/1986 Yakuwa ..... 123/479
4,658,786 4/1987 Foss et al. ..... 123/643 X
4,664,082 5/1987 Suzuki ..... 123/630 X
4,690,123 9/1987 Kimura et al. ..... 123/609 X

FOREIGN PATENT DOCUMENTS 0002469 1/1983 Japan .

*Primary Examiner*—Willis R. Wolfe
*Attorney, Agent, or Firm*—Antonelli, Terry & Wands

[57] ABSTRACT

An auxiliary revolution sensor (16) is disposed for detecting a reference position signal (16*a*) of each cylinders. A computer (3) outputs an auxiliary reference cylinder signal (3*d*) by the reference position signal (16*a*). A pseudo reference position signal generator (12, 13, 14, 15) generates a pseudo reference position signal (15*a*) by the auxiliary reference cylinder signal (3*d*). An electronic distributor (5) outputs ignition signals (6) to ignitors (6–11) by outputting signals of the pseudo reference position signal generator and the computer, when a revolution sensor (1) is out of order.

3 Claims, 2 Drawing Sheets

ELECTRONIC DISTRIBUTION BACKUP APPARATUS

FIELD OF THE INVENTION

This invention relates to a backup apparatus to cope with malfunction of a sensor outputting a signal relating to the revolution of an engine, and more particularly to an electronic distribution backup apparatus suitable for an engine controlling apparatus equipped with an electronic distributor.

BACKGROUND OF THE INVENTION

When a sensor for sensing the revolution of an engine fails, a conventional engine controlling apparatus becomes inoperative and the engine cannot be started. However, there is an increasing trend to provide a minimum necessary operation of the engine even when part of the control system is out of order. Particularly in the case of a controlling apparatus equipped with an electronic distributor, a proposal has been made in Japanese Patent Laid-Open No. 58-2469 (1983) published on Jan. 8, 1983 in the title of "Engine ignition control circuit" to output a pseudo ignition signal when part of a revolution sensor is out of order.

However, the prior art technique explained above does not at all take backup means into consideration when the revolution sensor does not at all operate. Accordingly, with total failure of the sensor the engine cannot operate at all.

SUMMARY OF THE INVENTION

An object of the present invention is to secure minimum necessary running even when the revolution sensor is out of order.

The object of the invention can be accomplished by providing an auxiliary revolution sensor for detecting a reference position signal so that an output signal of a reference cylinder can be detected by the output signal of this sensor, a pseudo reference position signal can be generated by the signal of the detected reference cylinder and the resulting pseudo reference position signal can be inputted to an electronic distributor.

According to the present invention, a malfunction of the revolution sensor is detected by comparing a reference position signal with an angle signal and the reference position signal to be input to an electronic distributor is switched to the pseudo reference position signal in the event of such malfunction.

Then, an ignition signal is distributed to each cylinder and the car does not become inoperative.

DETAILED DESCRIPTION OF THE PREFERRED EMBODIMENT

Figure 1:
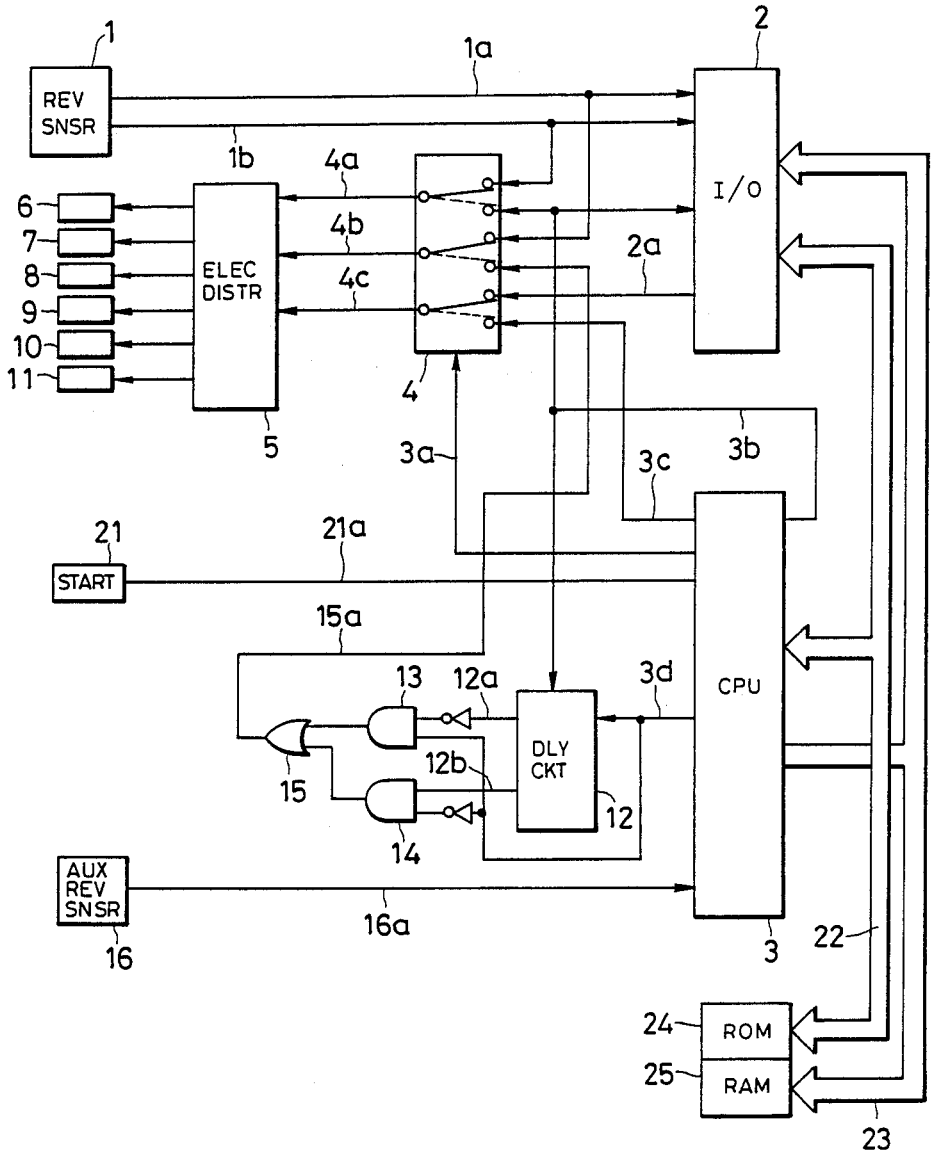
FIG. 1 is a block diagram showing one embodiment of the present invention.

Referring to FIG. 1, reference numeral 1 represents a revolution sensor; 2 is an input/output device; 3 is CPU; 4 is a change-over device; 5 is an electronic distributor; 6 through 11 are igniters; 12 is a delay circuit; 13 and 14 are AND circuits; 15 is an OR circuit; 16 is an auxiliary revolution sensor; 21 is a starter; 22 and 23 are data buses; 24 is a ROM; and 25 is a RAM. The delay circuit 12, AND circuits 13, 14, OR circuit 15, and the inverters connected between AND circuit 13 and the delay circuit 12 and connected between AND circuit 14 and CPU 3 constitute a pseudo reference position signal generator.

The revolution sensor 1 generates a reference position signal 1*a*, for instance, which is output at a predetermined angle before the upper dead point of the cylinder (e.g. 110°), for sensing the reference position of each cylinder and an angle signal 1*b* for sensing the angle of revolution of an engine, and these two signals are input to the input/output device 2. These input data are read by CPU 3 through the data buses 22 and 23. CPU 3 calculates an optimum ignition timing and an optimum power feed time to an ignition coil on the basis of these data. The result of calculation is sent to the input/output device 2 through the data bus 23 so as to output an ignition signal 2*a*.

When the system operates normally, the ignition signal 2*a* is input to the electronic distributor 5 as a signal 4*c* through the change-over device 4.

The reference position signal 1*a* and the angle signal 1*b* are input to the electronic distributor 5 as signals 4*a* and 4*b*, respectively, through the change-over device 4. The electronic distributor 5 discriminates the cylinder which is to be ignited at present in sequence from the reference position signal 1*a* and the angle signal 1*b*, and distributes the ignition signal 2*a* to an igniter 6–11 of each cylinder.

The ignition signal 2*a* output from the input/output device 2 is output based on the reference position signal 1*a* and the angle signal 1*b*. When the revolution sensor 1 is out of order, a normal ignition signal 2*a* can not be produced. The electronic distributor 5 distributes ignition signals to each cylinder. When the revolution sensor 1 is in trouble, the distribution by the electronic distributor 5 to each cylinder is impossible. At this time, CPU 3 detects the malfunction of the revolution sensor 1 and outputs a change-over signal 3*a* for backup to the change-over device 4.

Here, the malfunction of the revolution sensor 1 is detected in the following way.

(1) When a starter 21 operates and the engine is rotated at the start, a start signal 21*a* is input to CPU 3. If the reference position signal 1*a* and the angle signal 1*b* are not input to CPU 3 through the input/output device 2 from the revolution sensor 1 even after the passage of a predetermined period (e.g. 1 sec) from the application of the start signal 21*a* to CPU 3, the revolution sensor 1 is judged as abnormal.

(2) The reference position signal 1*a* produces the same number of pulses as the number of cylinders while the engine rotates twice, and the angle signal 1*b* produces pulses in accordance with the angle of revolution of the engine (such as one pulse for the revolution of the engine by 2°). At this time, the number of revolutions N of the engine can be calculated in accordance with equation (1) below by measuring the pulse period of the reference position signal 1*a*:

$$N = \frac{60}{T \cdot \frac{n}{2}} \text{ (rpm)} \tag{1}$$

where

N: number of revolutions (rpm)

T: pulse period (sec) of reference position signal 1a n: number of cylinders of engine.

On the other hand, the number of revolution can be calculated from equation (2) below by counting the number of pulses generated by the angle signal 1b for a predetermined period of time:

$$N = \frac{\frac{2xm}{360} \times 60}{t} \text{ (rpm)} \quad (2)$$

where t: counting time of angle signal 1b (sec)

m: number of pulses of angle signal 1b counted in the time t (sec)

with the proviso that equation. (2) can be established only when the pulse of the angle signal 1b is one pulse per revolution of engine by 2°.

The numbers of revolution obtained by equations (1) and (2) are compared with each other, and the revolution sensor 1 is judged as abnormal when they are remarkably different from each other. When the abnormality of the revolution sensor 1 is detected in the manner described above at CPU 3, the backup change-over signal or the failure judging signal 3a is applied to the change-over device 4, and the reference position signal 1a, the angle signal 1b and the ignition signal 2a to be input to the electronic distributor 5 are switched to the pseudo reference position signal 15a, the clock signal 3b generated from CPU 3 and serving as the base of the operations of CPU 3 and the input/output device 2 and the ignition backup signal 3c, respectively. The pseudo reference position signal 15a is generated by reading the period of the output pulse 16 of the auxiliary revolution sensor 16 by CPU 3 so as to disciminate the first cylinder as the reference cylinder, for example, calculating by AND circuits 13, 14 the relation between waveforms 12a and 12b obtained by delaying the auxiliary reference cylinder signal 3d, which is output when the reference cylinder is discriminated, by the delay circuit 12, and further providing the result from the OR circuit 15. Namely, pulses are generated at the rise and fall of the auxiliary reference cylinder signal 3d.

Figure 2:
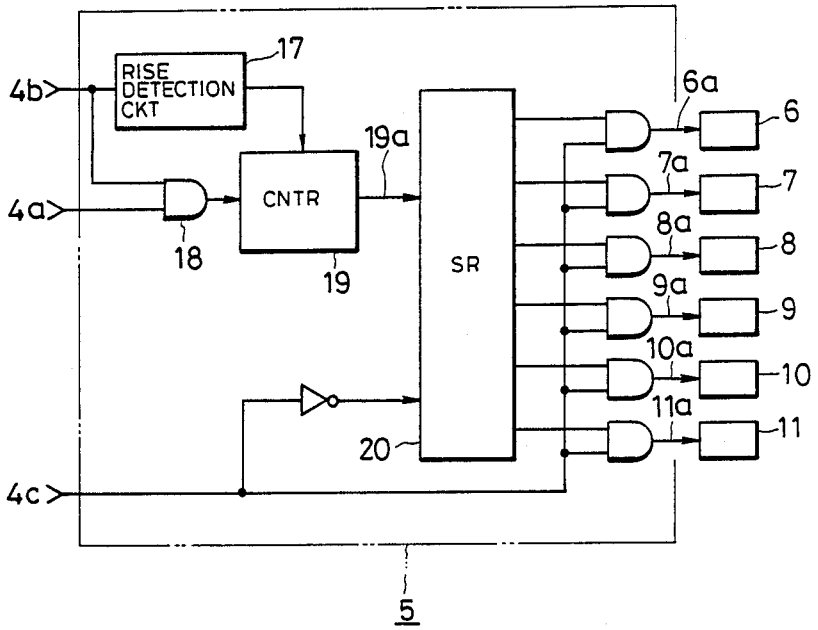
FIG. 2 is a block diagram showing in detail an electronic distributor shown in FIG. 1.

FIG. 2 is a block diagram showing in detail the electronic distribution circuit 5. The angle signal 4a generates 180 pulses, for example, per revolution of the engine, and the reference position signal 4b is generated at a predetermined angle before the upper dead point of each cylinder (e.g. 110°). This reference position signal 4b generates the same number of pulses as the number of cylinders, but contains a pulse wider than the pulses of the other cylinders in order to judge the ignition sequence of the reference cylinder. Judgment of this reference cylinder is made by taking the logical AND of the two signals by the AND circuit 18, counting the pulses by the counter 19 and outputting the reference cylinder signal 19a when a predetermined number, for instance 15, of the pulses are counted. The counter 19 is reset by a pulse generated by a rise detection circuit 17 which detects the rise of the reference position signal 4a that has passed through the change-over device 4. The reference cylinder signal 19a is applied to a shift register 20 and the reference cylinder signals 19a are sequentially shifted using the rise of the ignition signal 4c as the clock. The shifted signal is sequentially output to each cylinder in accordance with the ignition order, and the ignition signal 4c is distributed to each of the igniters disposed for the corresponding cylinders as signals 6a to 11a from the respective AND circuits.

Figure 3:
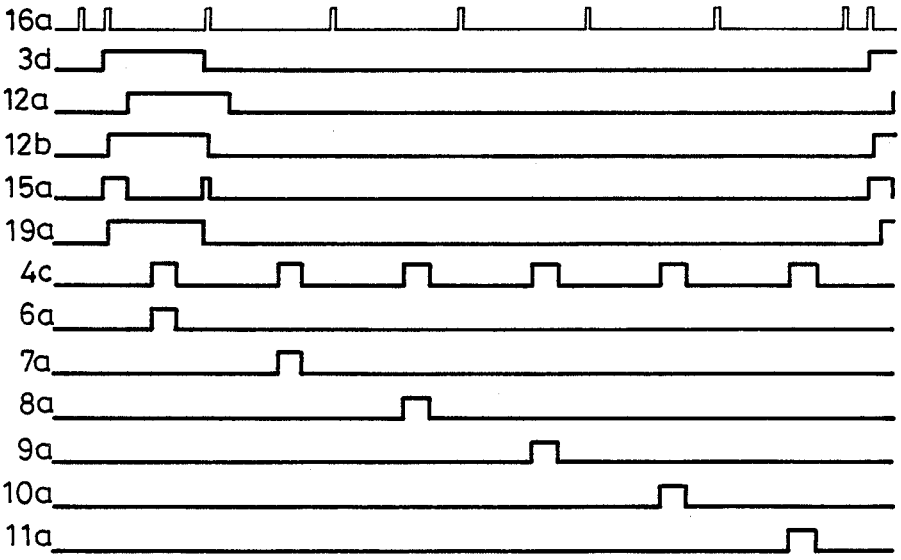
FIG. 3 is a flow chart for explaining the operation of the present invention.

FIG. 3 is a timing chart showing the operation of the present invention. The auxiliary revolution signal 16a as the output of the auxiliary revolution sensor 16 generates a pulse at a predetermined angle before the upper dead point of each cylinder, but generates continuously two pulses only at the time of the reference cylinder. As a method of judging the reference cylinder from this signal, the period between each pulse is measured by CPU 3 and is compared with the period that has been measured previously. If the change from the previous period is significant (such as below ¼ of the previous data), the reference cylinder is judged. At this time, the auxiliary reference cylinder signal 3d is set to "High" and is then set to "Low" when the next pulse is input.

The auxiliary reference cylinder signal 3d is shifted by the delay circuit 12 using the clock signal 3b output from CPU 3 as the clock. The delay circuit 12 generates the clock shift signal 12a obtained by shifting about 20 clock signals and the shift signal 12b obtained by shifting about 5 clock signals. A logical OR calculation is effected by the OR circuit 15 for the AND result between the inversed signal of the clock shift signal 12a and the auxiliary reference cylinder signal 3d and the AND result between the shift signal 12b and the inversed signal of the reference cylinder signal 3d. In this manner, there can be obtained the pseudo reference position signal 15a which is the synthetic signal obtained by combining about 20 pulses of the clock signal 3b from the rise of the auxiliary reference cylinder signal 3d and about 5 pulses of the clock signal 3b from the rise of the auxiliary reference cylinder signal.

The change-over signal 3a for backup is output when abnormality of the revolution sensor 1 is detected, and the input to the electronic distributor 5 is changed to the clock signal 3b output from CPU 3 in place of the angle signal 1b, the pseudo reference position signal 15a in place of the reference position signal 1a and the ignition backup signal 3c, which is equal to 4c in FIG. 3, in place of the ignition signal 2a, respectively. Inside the electronic distributor 5, the counter 19 discriminates the reference cylinder from the pseudo reference position signal 15a and the clock signal 3b. Originally, when the revolution sensor 1 is normal, the reference cylinder is judged when the number of pulses of the AND result between the reference position signal 1a and the angle signal 1b is more than 15. Accordingly, the reference cylinder is judged when the first pulse of the pseudo reference position signal 15a has a pulse width which is substantially more than 15 clock signals 3b. If the width 12b of the second pulse from the delay circuit 12 is about 5 clock signals, the reference cylinder is not judged, so that the rise detection circuit 17 detects only the rise of the signal, and the counter 19 is reset to set the reference position signal 19a to "Low". When this reference position signal 19a is shifted by the shift register 20 using the fall of the ignition backup signal 3c as the clock, the ignition backup signal 3c can be distributed to each cylinder.

As can be understood from the description given above, ignition for each cylinder can be backed up even when the revolution sensor 1 is out of order, and minimum necessary driving operation can be secured.

What we claim is:

1. An electric distribution backup apparatus comprising an electronic distributor for sequentially distributing an ignition signal to each of a plurality of igniters disposed so as to correspond to respective ones of a plurality of cylinders of an engine on the basis of a reference position signal for each of said cylinders generated by a revolution sensor in accordance with the revolution of said engine and on the basis of a rotating angle signal generated by said revolution sensor, the improvement comprising:

an auxiliary revolution sensor for detecting another reference position signal of each of said cylinders when said revolution sensor for generating said two signals is out of order; control means for outputting a failure judging signal in response to detection of the failure of said revolution sensor on the basis of the two signals from revolution sensor, for outputting an auxiliary reference cylinder signal on the basis of a signal from said auxiliary revolution sensor, for outputting a clock signal in place of said rotating angle signal, and for outputting an ignition backup signal; and a pseudo reference position signal generator for generating a pseudo reference position signal in place of said reference position signal on the basis of said auxiliary reference cylinder signal; wherein said clock signal, said pseudo reference position signal, and said ignition backup signal are input to said electronic distributor, when said revolution sensor is out of order so that each of said igniters is ignited sequentially.

2. The electric distribution backup apparatus according to claim 1 further comprising a change-over means for changing-over said reference position signal, said rotating angle signal, and an ignition signal to apply said clock signal, said pseudo reference position signal, and said ignition backup signal, respectively, to said electronic distributor when said failure judging signal is input to said change-over device.

3. The electric distribution backup apparatus according to claim 2, wherein said pseudo reference position signal generator comprises delay means for delaying said auxiliary reference cylinder signal so as to produce first and second delayed output signals, a first inverter for inverting said first delayed output signal, a second inverter for inverting said auxiliary reference cylinder signal, a first AND gate connected to receive said auxiliary reference cylinder signal and the output of said first inverter, a second AND gate connected to receive said second delayed output signal and the output of said second inverter, and an OR gate connected to the outputs of said first and second AND gates for producing said pseudo reference position signal.

* * * * *